US007207344B2

(12) United States Patent
Wu

(10) Patent No.: US 7,207,344 B2
(45) Date of Patent: Apr. 24, 2007

(54) TWO TIER CANOPY SYSTEM

(75) Inventor: Chung Sen Wu, Taipei (TW)

(73) Assignee: Caravan Canopy International, Inc., Compton, CA (US)

( * ) Notice: Subject to any disclaimer, the term of this patent is extended or adjusted under 35 U.S.C. 154(b) by 327 days.

(21) Appl. No.: 10/778,750

(22) Filed: Feb. 13, 2004

(65) Prior Publication Data

US 2005/0178422 A1 Aug. 18, 2005

(51) Int. Cl.
*E04H 15/34* (2006.01)
*E04H 15/54* (2006.01)

(52) U.S. Cl. ..... 135/158; 135/160

(58) Field of Classification Search ..... 135/158, 135/114, 115, 119, 33.7, 94, 98, 159, 135, 135/138, 147, 144; 52/57, 82, 198, 83, 63
See application file for complete search history.

(56) References Cited

U.S. PATENT DOCUMENTS 3,040,478 A * 6/1962 Ferguson ..... 52/82
3,456,661 A 7/1969 Farley
3,724,473 A * 4/1973 Moss ..... 135/94
4,606,366 A * 8/1986 Collet ..... 135/20.1
5,226,438 A 7/1993 Dubinsky
5,244,001 A 9/1993 Lynch
5,494,066 A * 2/1996 McMahan ..... 135/87
D369,638 S 5/1996 Smith
D373,468 S 9/1996 Dubinsky
5,601,103 A 2/1997 Dubinsky
5,871,026 A 2/1999 Lin
D434,156 S 11/2000 McDonald
6,283,136 B1 * 9/2001 Chen ..... 135/147
D458,689 S 6/2002 Wang
D471,645 S 3/2003 Wang
D473,321 S 4/2003 Wang
D473,322 S 4/2003 Wang
D473,660 S 4/2003 Wang
6,601,597 B2 * 8/2003 Sung ..... 135/33.7
6,681,784 B2 * 1/2004 Chou et al. ..... 135/33.7

FOREIGN PATENT DOCUMENTS

GB 2162220 A * 1/1986
GB 2 400 386 A 10/2004

OTHER PUBLICATIONS

Print out from the Internet; www.arquatiusa.com; Jul. 21, 2003, 2 pages.

(Continued)

*Primary Examiner*—Tamara L. Graysay
(74) *Attorney, Agent, or Firm*—Christie, Parker & Hale, LLP

(57) ABSTRACT

A two-tier canopy system is provided that includes a canopy support structure having a central post and a plurality of radially extending arms. A first canopy covering is supported by the radially extending arms and has a central opening, wherein the central post extends through the central opening. A second canopy covering, having at least a portion thereof disposed above the central opening, is supported by the central post, wherein the central post is biased towards the second canopy covering.

15 Claims, 8 Drawing Sheets

OTHER PUBLICATIONS

Print out from the Internet; www.patioumbrellas.com; Jul. 8, 2003; 2 pages.
Printout from the Internet; www.ediscountwholesalers.com; Jul. 21, 2003; 3 pages.
Trademark Electronic Search System (TESS) for Word Mark PAPILLON; Jul. 22, 2003; 1 page.
Print out from the Internet; www.bellon.qc.ca/parasol.htp; Feb. 12, 2004; 1 page.
Installation Instructions for the Papillon Patio Cover; 2 pages.
Search Report from the UK Patent Office for UK Application No. GB 2 400 386 A, date of search May 3, 2005, 1 page.

* cited by examiner

TWO TIER CANOPY SYSTEM

FIELD OF THE INVENTION

The present invention relates generally to a two-tier canopy system having first and second canopy coverings, wherein the first canopy covering has a central opening and the second canopy covering is supported by a central post that extends through the central opening and is biased towards the second canopy covering.

BACKGROUND OF THE INVENTION

Canopies often include support structures that support a covering. The support structure typically includes a frame having legs that extend upwardly from a ground surface and arms that extend from the legs. The covering often is disposed directly above and attached to the arms. It is often desirable to stretch the covering tautly over the arms to produce an overall appearance that is visually appealing.

SUMMARY

In one exemplary embodiment, the present invention is a two-tier canopy system that includes a canopy support structure having a central post and a plurality of radially extending arms. A first canopy covering is supported by the radially extending arms and has a central opening, wherein the central post extends through the central opening. A second canopy covering, having at least a portion thereof disposed above the central opening, is supported by the central post, which is biased towards the second canopy covering.

In another exemplary embodiment, the present invention is a two-tier canopy system that includes a canopy support structure having a central post and a plurality of radially extending arms, wherein the central post includes an upper sleeve that is slideable relative to a lower sleeve, such that the length of the central post varies. A first canopy covering is supported by the radially extending arms and has a central opening, wherein the central post extends through the central opening. A second canopy covering, having at least a portion thereof disposed above the central opening, is supported by the central post, which is biased towards the second canopy covering. At least one of the plurality of radially extending arms has a hook that extends through the central opening and attaches to the second canopy.

BRIEF DESCRIPTION OF THE DRAWINGS

The exemplary embodiments of the present invention will be better understood by reference to the following detailed description when considered in conjunction with the accompanying drawings wherein.

DETAILED DESCRIPTION OF THE INVENTION

As shown in FIGS. 1–8, exemplary embodiments of the present invention are directed to a two-tier canopy system having first and second canopy coverings, wherein the first canopy covering has a central opening and the second canopy covering is supported by a central post (or center pole) that extends through the central opening and is biased towards the second canopy covering.

Figure 1:
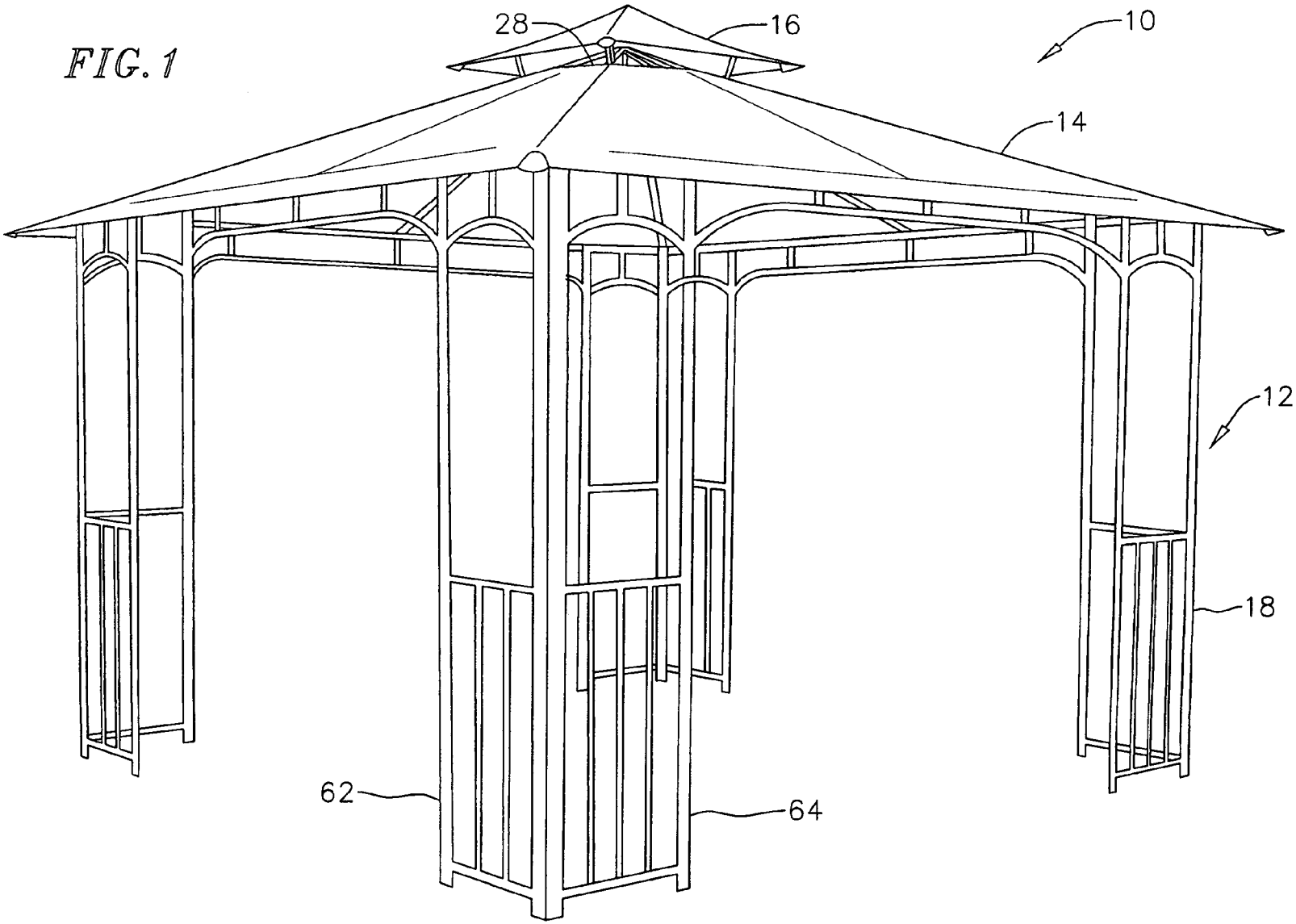
FIG. 1 is a perspective view of a two tier canopy system according to one exemplary embodiment of the present invention.
Figure 2:
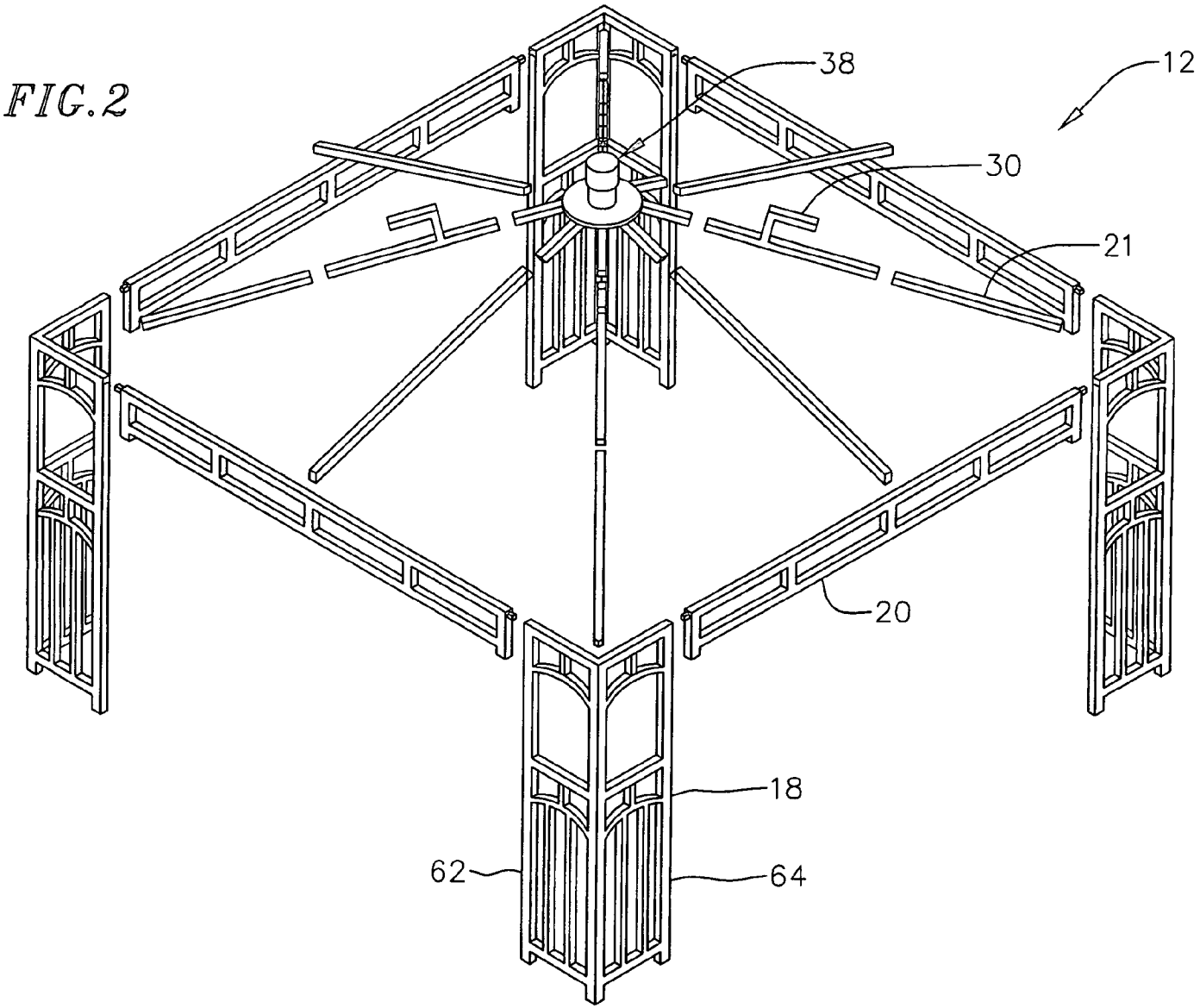
FIG. 2 is an exploded perspective view of one exemplary embodiment of a support structure for use in the two tier canopy system of FIG. 1.

As shown in FIG. 1, the two tier canopy system 10 includes a support structure 12 for supporting both a first covering 14 and a second covering 16. As shown in FIG. 2, the support structure 12 includes vertically extending legs 18 that are laterally supported by a frame member 20. In the exemplary embodiment of FIG. 2, the frame member 20 is formed in a substantially square-shaped configuration. However, in other embodiments the frame member 20 may form rectangular and/or other configurations. As used herein terms such as "upper", "lower", "top" and "bottom" are relative terms and do not necessarily denote the actual position of an element.

Each of the legs 18 is formed from a pair of two substantially rectangular leg frames 62 and 64 that are positioned at substantially 90 degrees of one another. The edge joining the leg frames 62 and 64 define the respective corner of the support structure 12. The leg frames 62 and 64, for example, may be joined to each other through welding, screw fastening and/or any other suitable fastening method known to those skilled in the art. The legs 18 may have any other shapes and/or decorations in other embodiments. The legs 18 are attached to the frame member 20 by any one of a variety of fastening methods, such as welding and/or any other suitable fastening device/method.

Figure 3:
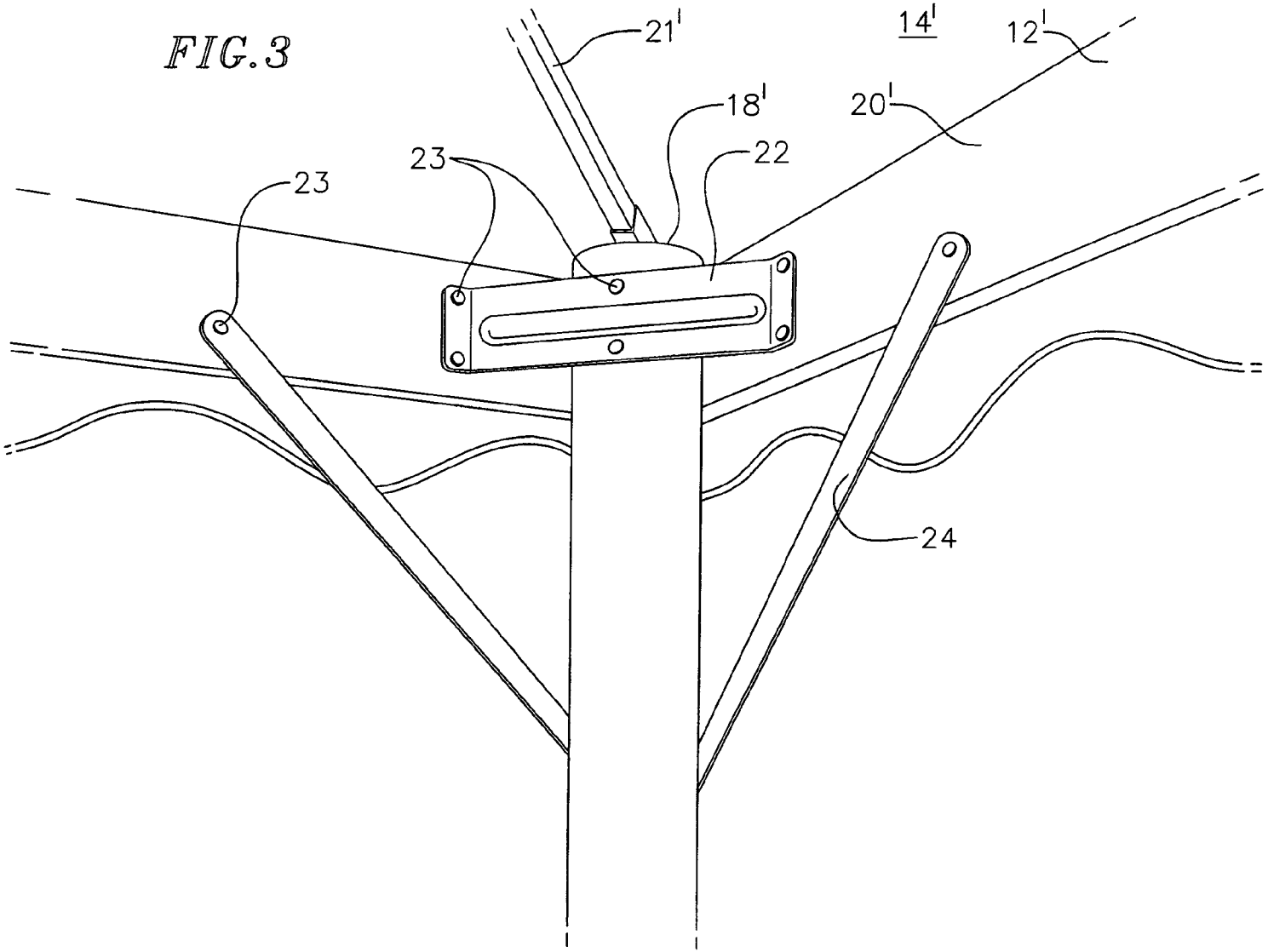
FIG. 3 is an inside perspective view of a corner of a support structure according to another exemplary embodiment, showing a leg of the support structure mounted to a frame of the support structure.

FIG. 3 illustrates an inside perspective view of a corner of a support structure 12' for a two-tier canopy in another exemplary embodiment according to the present invention. In the exemplary embodiment of FIG. 3, legs 18' are column-shaped unlike the legs made of rectangular leg frames in the exemplary embodiment of FIG. 1. However, the mechanism for realizing the two-tier canopy is substantially the same in both exemplary embodiments.

Each leg 18' is attached to the frame member 20' by a mounting plate 22 and one or more braces 24. The mounting plate 22 secures the leg 18' against an inner corner of the frame 20' by fasteners 23, such as screw fasteners. The braces 24 further secure the leg 18' to the frame 20 by fasteners 23. While the legs 18' each have a column shape, in practice, the legs 18' may have any appropriate shape, configuration and/or decoration.

Unlike the first covering 14 of FIG. 1, a first covering 14' of FIG. 3 has scalloped edges 65 around its periphery. However, such scalloped edges are used for ornamental purposes only, and the first covering 14' is attached to the support frame 12' in substantially the same way as how the first covering 14 is attached the support frame 12. Further, the first coverings 14 and 14' are interchangeable provided that the support frames 12 and 12' have substantially the same size.

Returning now to FIG. 2, the support structure 12 includes a plurality of arms 21. Each arm 21 is connected to the frame 20 and/or one of the legs 18 by any one of a variety of fastening devices/methods, such as welding and/or other fastening devices/methods. In the exemplary embodiment of FIG. 2, the arms 21 are approximately equally spaced and radially extend in a substantially conical configuration. However, in other embodiments the arms 21 may form other configurations.

Figure 5:
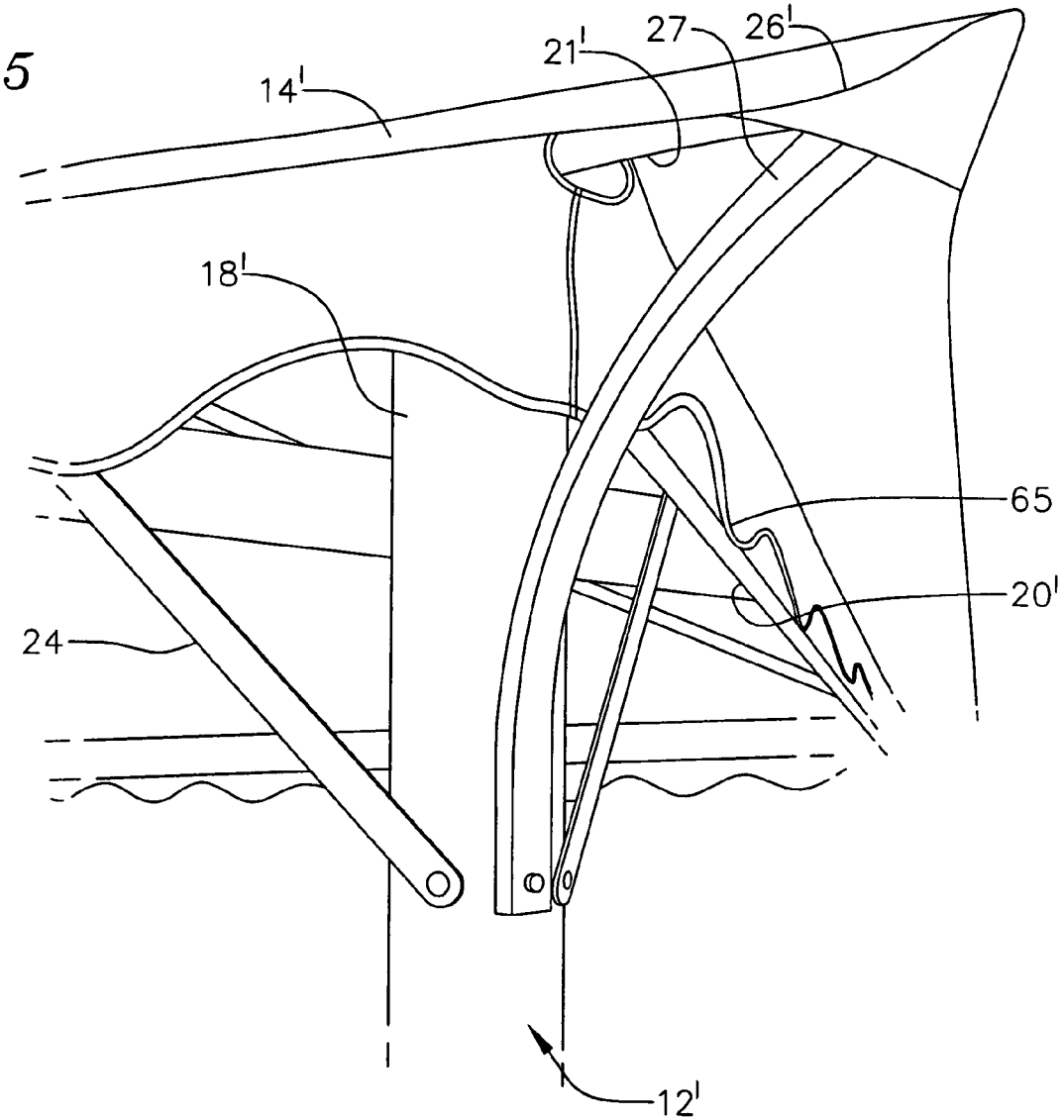
FIG. 5 is an outside perspective view of a corner of the support structure of FIG. 3, showing a receiving portion for attaching the support structure to a first covering of the two tier canopy system.

The support structure 12' of FIG. 3 also includes arms 21' that are substantially the same as the arms 21 of FIG. 2. In addition, the support structure 12' includes arm support members 27 (as shown in FIG. 5), each of which is disposed between the respective arm 21' and the leg 18' As shown in FIG. 5, the arm support member 27 has a curvature that is convex towards the corner of the support structure 12' when viewed from the outside of the two-tier canopy. However, in other embodiments, the arm support members may be straight or have any other curvatures suitable for supporting the arm 21'.

Figure 4:
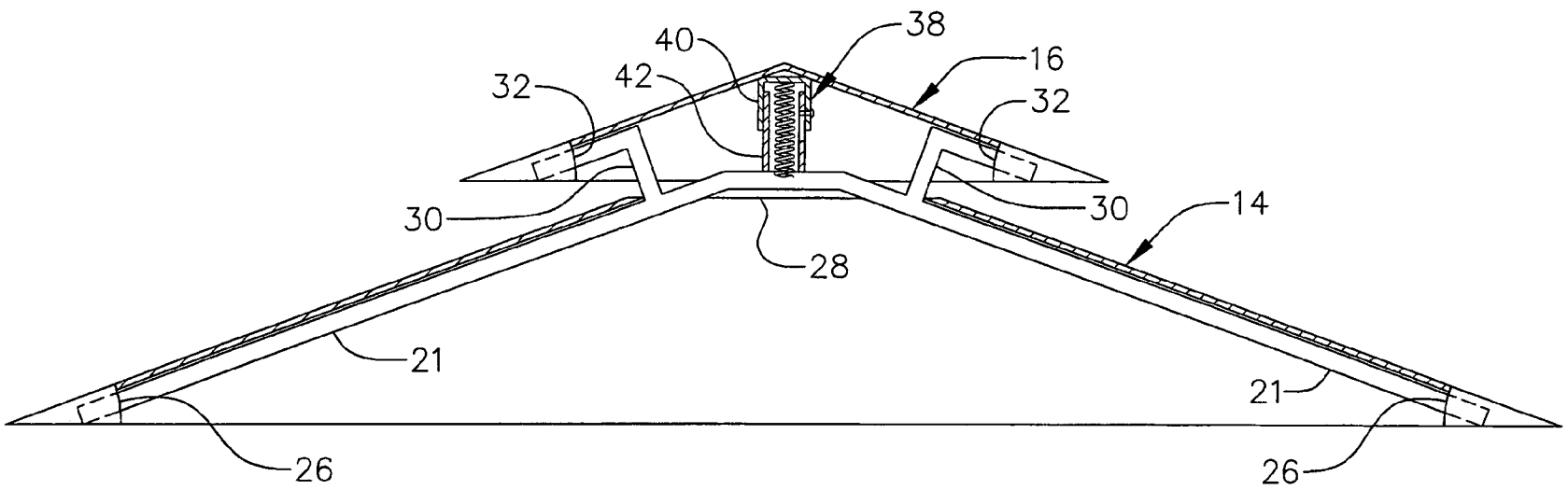
FIG. 4 is a side cross-sectional view of the two tier canopy system of FIG. 1.

As shown, for example in FIG. 4, the first covering 14 is disposed directly above the arms 21 and is attached to one or more of the arms 21. As shown in FIG. 4, the first covering 14 includes a plurality of sleeves 26, wherein each sleeve 26 forms a pocket that receives a peripheral end of a corresponding one of the arms 21. In one embodiment, the sleeves 26 are individually mounted to the first covering 14. The sleeves 26 may be formed of the same material of the first covering 14 or the sleeves 26 may be formed of a material that is stronger than the first covering 14 so that the arms 21 are less likely to tear the sleeves 26 when the arms 21 are attached therein. For example, in one embodiment the first covering 14 is made of a canvass material and the sleeves 26 are made of a leather material.

The sleeves 26 may be attached to the first covering 14 by any one of a variety of fastening methods, such as by stitching or threading. In another embodiment, the sleeves 26 may be integrally formed with the first covering 14. In one embodiment, the support structure 12 includes eight arms 21 and the first covering 14 includes four sleeves 26, such that every other arm 21 is attached to a corresponding sleeve.

It can be seen in FIG. 5 that the first covering 14' is disposed directly above and attached to the arms 21' in substantially the same relationship as the first covering 14 and the arms 21. Hence, the first covering 14' also includes a plurality of sleeves 26', wherein each sleeve 26' forms a pocket that receives a peripheral end of a corresponding one of the arms 21'. The first covering 14', the arms 21' and the sleeves 26', for example, may have substantially the same configuration, number and sizes as, and be made using the same material and methods as the first covering 14, the arms 21 and the sleeves 26, respectively.

Figure 6:
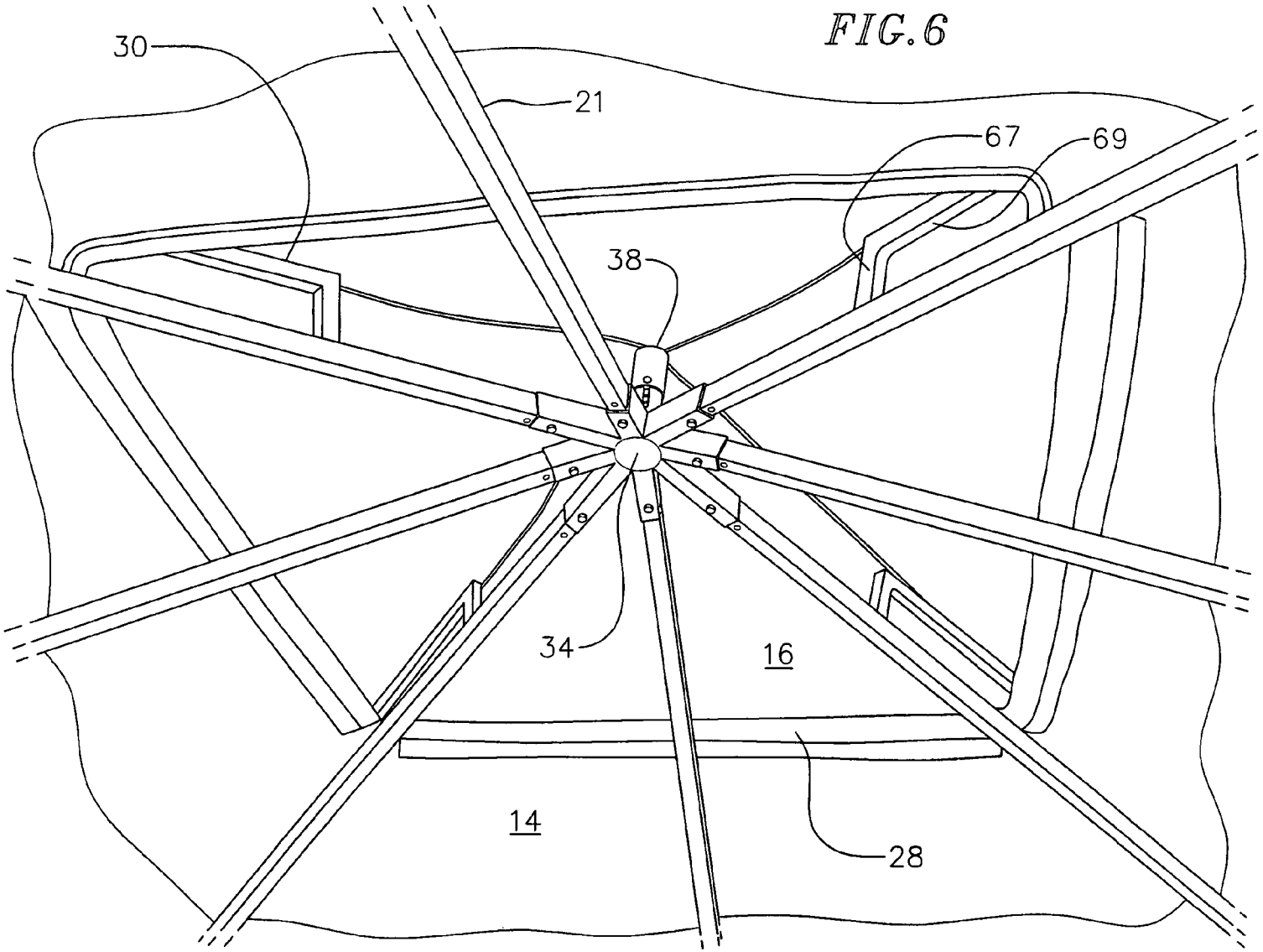
FIG. 6 is a bottom perspective view of the support structure of FIG. 2 being used to support first and second coverings of the two tier canopy system of FIG. 1.

As shown for example in FIG. 4, the first covering 14 has a central opening 28 (see also FIGS. 1 and 6). At least a portion of the second covering 16 is disposed above the central opening 28. Corresponding ones of the arms 21 have hooks 30 that extend through the central opening 28 and attach to the second covering 16. Each hook has a generally vertical member 67 that protrudes upward from the respective arm 21 and a generally horizontal member 69 that is attached to the upper end of the generally vertical member 67 and extends outward towards the four corners of the two-tier canopy.

As with the first covering 14, the second covering 16 includes a plurality of sleeves 32, wherein each sleeve 32 forms a pocket that receives a peripheral end of the generally horizontal member 69 of a corresponding one of the hooks 30. For example, as can be seen in FIG. 6, the generally vertical members 67 are attached to the respective arms 21 between the center of the two-tier canopy and four vertices of a square periphery of the second covering 16. The generally horizontal members 69 extend all the way to the four vertices of the second covering 16 so as to engage the respective sleeves 32.

In one exemplary embodiment, the sleeves 32 are individually mounted to the second covering 16. The sleeves 32 may be formed of the same material as the second covering 16 or the sleeves 32 may be formed of a material that is stronger than the second covering 16 so that the hooks 30 are less likely to tear the sleeves 32 when the hooks 30 are attached therein. For example, in one exemplary embodiment the second covering 16 is made of a canvass material and the sleeves 32 are made of a leather material.

The sleeves 32 may be attached to the second covering 16 by any one of a variety of fastening methods, such as by stitching or threading. In another exemplary embodiment, the sleeves 32 may be integrally formed with the second covering 16. In one embodiment, the support structure 12 includes eight arms 21, with a hook 30 extending from every other arm 21 and the second covering 16 includes four sleeves 32, which each receive a corresponding one of the hooks 30.

Figure 7:
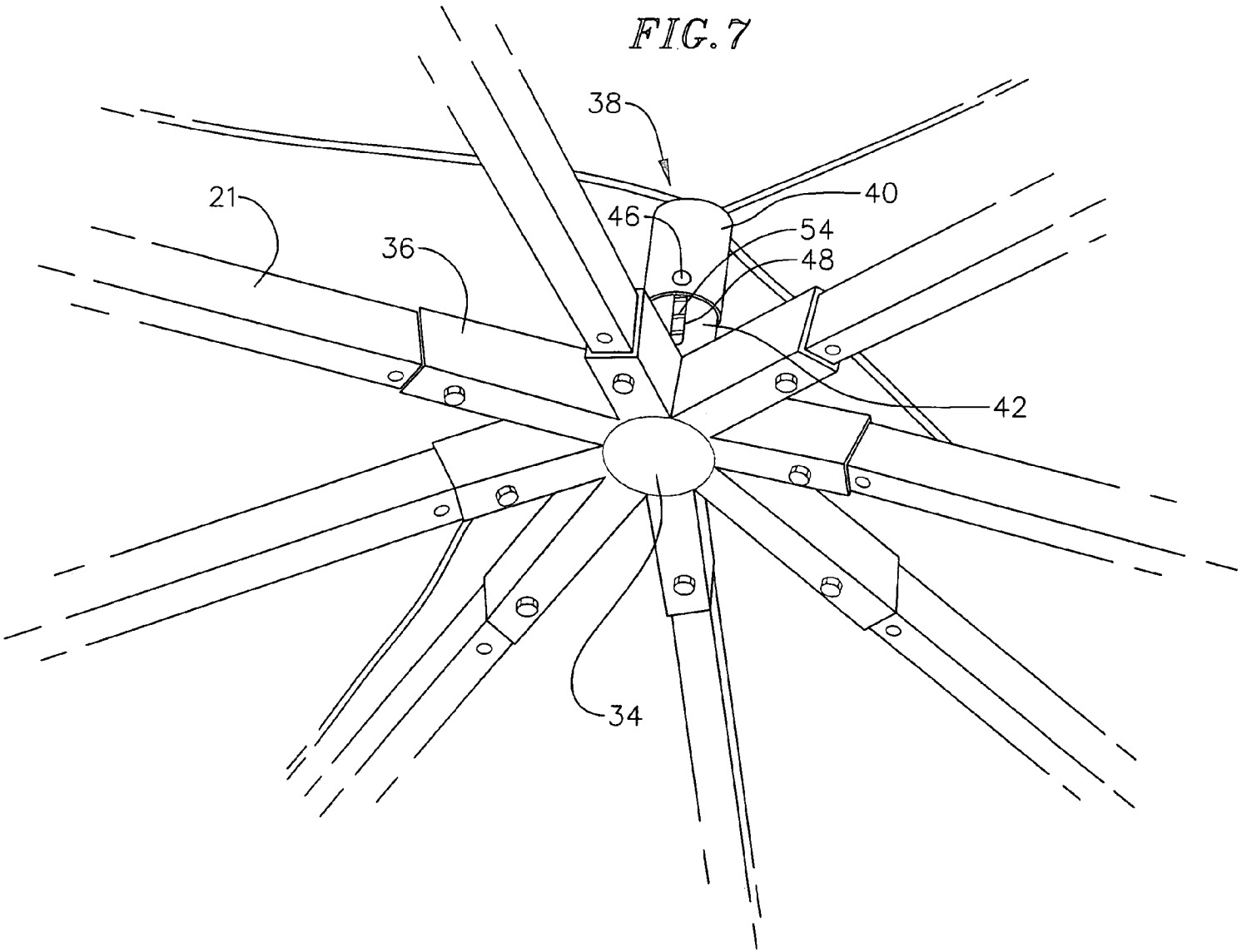
FIG. 7 is an enlarged view of FIG. 6, showing a central post for supporting the second covering of the two tier canopy system of FIG. 1.

As shown in FIG. 7, the support structure 12 includes a connecting plate 34. The connecting plate 34 includes a plurality of radially extending spokes 36. Each spoke 36 includes an opening for receiving a corresponding one of the arms 21. Each arm 21 is attached to its corresponding spoke by any one of a variety of fastening device/methods, such as welding, bolts, screws and/or any other suitable fastening devices/methods.

Figure 8:
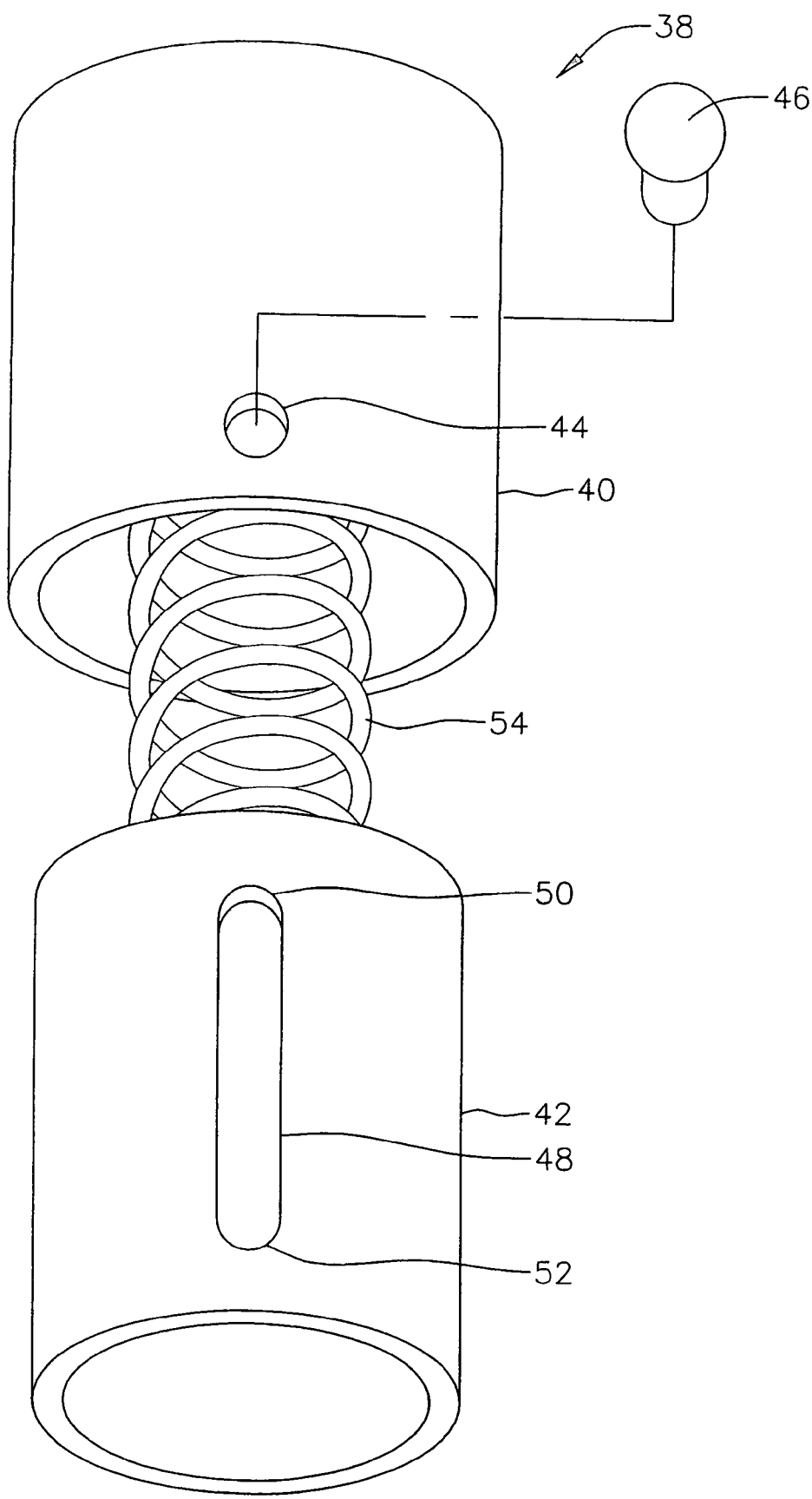
FIG. 8 is an exploded schematic view of the central post of FIG. 7.

Also attached to the connecting plate 34 is a central post 38. The central post 38 extends through the central opening 28 of the first covering 14 to support an intermediate portion of the second covering 16. As shown in FIG. 8, the central post 38 includes an upper sleeve 40 and a lower sleeve 42. The upper sleeve 40 is slidably connected to the lower sleeve 42, so that the upper sleeve 40 overlaps a varying portion of the lower sleeve 42 depending of the position of the upper sleeve 40 relative to the lower sleeve 42. As such the length of the central post 38 varies depending on the position of the upper sleeve 40 relative to the lower sleeve 42.

In the depicted embodiment of FIG. 8, the upper sleeve 40 includes an opening 44 for receiving a pin 46. The pin 46 also extends into a slot 48 in the lower sleeve 42. The slot 48 defines the maximum and minimum overlapping of the upper sleeve 40 relative to the lower sleeve 42, and therefore defines the maximum and minimum lengths of the central post 38. That is, when the pin 46 contacts an upper end 50 of the slot 48, the overlapping portion of the upper sleeve 40 relative to the lower sleeve 42 is minimized and the length of the central post 38 is maximized; and when the pin 46 contacts an lower end 52 of the slot 48, the overlapping portion of the upper sleeve 40 relative to the lower sleeve 42 is maximized and the length of the central post 38 is minimized.

The lower sleeve 42 may be integral formed with or rigidly affixed to a top surface of the plate 34. The central post 38 includes a biasing member 54, for example a spring such as a compression spring, for biasing the upper sleeve 40 away from the lower sleeve 42 and towards the second covering 16. As such, the central post 38 biases the second covering 16 upwardly. For example in the exemplary embodiment of FIG. 8, a lower portion of the biasing member 54 contacts a lower surface of the lower sleeve 42 and an upper portion of the biasing member contacts an upper surface of the upper sleeve 40.

The upward biasing of the central post 38 on the intermediate portion of the second covering 16, which may be located approximately in the center of the second covering 16, causes the second covering sleeves 32 to be pulled closely against the hooks 30 of the support structure 12. Thus causing the second covering 16 to be tautly held to the support structure 12. Therefore, during the installation of the second covering 16 in the two-tier canopy system of FIG. 1, the central post 38 may be compressed to insert the hooks 30 into the sleeves 32, and then released so that the second covering 16 is tightly supported by the central post 38 and the four hooks 30. Further, to remove the second covering 16, the central post 38 may be compressed to loosen the second covering 16 to facilitate unhooking thereof. Although FIG. 8 depicts the lower sleeve 42 as sliding within the upper sleeve 40, in another embodiment, the upper sleeve 40 slides within the lower sleeve 42.

While the hooks 30, the connecting plate 34, the central post 38, the second covering 16 and the sleeves 32 of FIGS. 4 and 6–8 have been described in reference to the exemplary two-tier canopy system of FIGS. 1 and 2, they may be applicable equally as well to the exemplary two-tier canopy system of FIGS. 3 and 5. Therefore, it is to be understood that the exemplary embodiment of FIGS. 3 and 5 has substantially the same hooks, connecting plate, central post, second covering and the sleeves as described herein.

In one embodiment, the support structure 12 is made from a metal material such as stainless steel and the coverings 14 and 16 and covering sleeves 26 and 32 are made from a cloth material, such as canvass or leather. The support structure 12' of FIGS. 3 and 5 may be made of substantially the same material as the support structure 12. Further, the first and second coverings and the covering sleeves for the support structure 12' may also be made of substantially the same material as the covering 14 and 16 and the covering sleeves 26 and 32, respectively.

The preceding description has been presented with references to certain exemplary embodiments of the invention. Persons skilled in the art and technology to which this invention pertains will appreciate that alterations and changes in the described structures and methods of operation can be practiced without meaningfully departing from the principle, spirit and scope of this invention. Accordingly, the foregoing description should not be read as pertaining only to the precise structures described and shown in the accompanying drawings.

What is claimed is:

1. A two-tier canopy system comprising:

a canopy support structure having a central post and a plurality of radially extending arms, the central post comprising an upper sleeve that is slideable relative to a lower sleeve, such that the length of the central post varies;

a first canopy covering supported by the radially extending arms and having a central opening, wherein the central post extends through the central opening; and a second canopy covering, having at least a portion thereof disposed above the central opening, supported by the central post, wherein the central post is biased towards the second canopy covering, wherein the central post comprises biasing means for biasing the upper sleeve towards the second canopy covering.

2. The canopy system of claim 1, wherein the upper sleeve contacts and supports an intermediate portion of the second canopy covering.

3. The canopy system of claim 1, wherein the biasing means is a spring.

4. A two-tier canopy system comprising:

a canopy support structure having a central post and a plurality of radially extending arms, wherein the central post comprises an upper sleeve that is slideable relative to a lower sleeve, such that the length of the central post varies, wherein the canopy support structure comprises a plurality of leg frames located at its corners to support the central post and the radially extending arms;

a first canopy covering supported by the radially extending arms and having a central opening, wherein the central post extends through the central opening;

a second canopy covering, having at least a portion thereof disposed above the central opening, supported by the central post, wherein the central post is biased towards the second canopy covering, and wherein at least one of the plurality of radially extending arms has a hook that extends through the central opening and attaches to the second canopy.

5. The canopy system of claim 4, wherein the central post is biased against the second canopy covering.

6. The canopy system of claim 4, wherein the second canopy covering comprises receiving means for securing the hook to the second canopy covering.

7. The canopy system of claim 6, wherein the receiving means comprises a pocket for receiving the hook.

8. A two-tier canopy system comprising:

a canopy support structure having a central post and a plurality of radially extending arms, wherein the central post comprises an upper sleeve that is slideable relative to a lower sleeve, such that the length of the central post varies;

a first canopy covering supported by the radially extending arms and having a central opening, wherein the central post extends through the central opening;

a second canopy covering, having at least a portion thereof disposed above the central opening, supported by the central post, wherein the central post is biased towards the second canopy covering, and wherein at least one of the plurality of radially extending arms has a hook that extends through the central opening and attaches to the second canopy, wherein the central post is biased against the second canopy covering, and wherein the upper sleeve contacts and supports an intermediate portion of the second canopy covering.

9. The canopy system of claim 8, wherein the plurality of radially extending arms comprises four arms, each having a hook that extends through the central opening and attaches to the second canopy.

10. The canopy system of claim 9, wherein the first canopy covering comprises receiving means for securing each of the plurality of radially extending arms to the first canopy covering, and wherein the second canopy covering comprises receiving means for securing each hook to the second canopy covering.

11. The canopy system of claim 10, wherein the receiving means of the first canopy covering comprises four pockets, each for receiving a corresponding one of the plurality of radially extending arms and wherein the receiving means of the second canopy covering comprises four pockets, each for receiving a corresponding one of the four hooks.

12. A two-tier canopy system comprising:

a canopy support structure having a central post and a plurality of radially extending arms, wherein the central post comprises an upper sleeve that is slideable relative to a lower sleeve, such that the length of the central post varies;

a first canopy covering supported by the radially extending arms and having a central opening, wherein the central post extends through the central opening;

a second canopy covering, having at least a portion thereof disposed above the central opening, supported by the central post, wherein the central post is biased towards the second canopy covering, and wherein at least one of the plurality of radially extending arms has a hook that extends through the central opening and attaches to the second canopy, wherein the support structure comprises a connecting plate having a plurality of spokes, wherein each spoke is attached to a corresponding one of the plurality of radially extending arms and wherein the lower sleeve is fixedly attached to a top surface of the connecting plate.

13. A two-tier canopy system comprising:

a canopy support structure having a central post and at least four radially extending arms, wherein the central post comprises an upper sleeve that is slideable relative to a lower sleeve, such that the length of the central post varies;

a first canopy covering having at least four corners and a central opening, wherein the central post extends through the central opening and wherein the first canopy covering is supported by the at least four radially extending arms, which each extend into a pocket in a corresponding one of the four corners of the first canopy covering;

a second canopy covering having at least portion thereof disposed above the central opening, wherein the central post is biased towards the second canopy covering to contact and support the second canopy covering, wherein the central post comprises biasing means for biasing the upper sleeve towards the second canopy covering, and wherein the second canopy covering comprises at least four corners, such that each of the at least four radially extending arms comprises a hook that extends through the central opening and extends into a pocket in a corresponding one of the four corners of the second canopy covering.

14. The canopy system of claim 13, wherein the support structure comprises a connecting plate having a plurality of spokes, wherein each spoke is attached to a corresponding one of the at least four radially extending arms and wherein the lower sleeve is fixedly attached to a top surface of the connecting plate.

15. A two-tier canopy system comprising:

a canopy support structure having a central post and a plurality of radially extending arms, wherein the canopy support structure comprises a plurality of leg frames located at its corners to support the central post and the radially extending arms;

a first canopy covering supported by the radially extending arms and having a central opening, wherein the central post extends through the central opening; and a second canopy covering, having at least a portion thereof disposed above the central opening, supported by the central post, wherein the central post is biased towards the second canopy covering, wherein the central post comprises an upper sleeve that is slideable relative to a lower sleeve, such that the length of the central post varies.

* * * * *

UNITED STATES PATENT AND TRADEMARK OFFICE

CERTIFICATE OF CORRECTION

PATENT NO. : 7,207,344 B2
APPLICATION NO. : 10/778750
DATED : April 24, 2007
INVENTOR(S) : Wu It is certified that error appears in the above-identified patent and that said Letters Patent is hereby corrected as shown below:

In the Claims

| | |
|---|---|
| Column 8, line 1, Claim 13 | After "at least",<br>Insert --a-- |

Signed and Sealed this

Twenty-first Day of August, 2007

JON W. DUDAS
*Director of the United States Patent and Trademark Office*